US007182020B2

(12) United States Patent
Herbert

(10) Patent No.: US 7,182,020 B2
(45) Date of Patent: Feb. 27, 2007

(54) DEVICES FOR GUIDING A PARTIAL WIDTH WEB, GUIDE ELEMENT FOR GUIDING A PARTIAL WIDTH WEB AND PROCESSING MACHINE COMPRISING SAID DEVICES

(75) Inventor: Burkard Otto Herbert, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 157 days.

(21) Appl. No.: 10/522,985

(22) PCT Filed: Jul. 26, 2003

(86) PCT No.: PCT/DE03/02526

§ 371 (c)(1),
(2), (4) Date: Feb. 2, 2005

(87) PCT Pub. No.: WO2004/014770

PCT Pub. Date: Feb. 19, 2004

(65) Prior Publication Data

US 2006/0162595 A1 Jul. 27, 2006

(30) Foreign Application Priority Data

Aug. 2, 2002 (DE) ..... 102 35 391

(51) Int. Cl.
*B41F 13/54* (2006.01)
*B65H 23/32* (2006.01)

(52) U.S. Cl. ..... 101/228; 101/227; 242/615.21; 270/52.08

(58) Field of Classification Search ..... 101/227, 101/228; 226/189, 190, 192; 242/615.21; 270/10, 52.07, 52.08
See application file for complete search history.

(56) References Cited

U.S. PATENT DOCUMENTS

| | | | | |
|---|---|---|---|---|
| 2,378,234 | A * | 6/1945 | Meyer | 101/225 |
| 3,809,303 | A * | 5/1974 | Brunner | 226/196.1 |
| 5,100,117 | A * | 3/1992 | Hajek et al. | 270/52.08 |
| 5,108,022 | A * | 4/1992 | Birkmair et al. | 242/615.21 |
| 5,685,528 | A * | 11/1997 | Weis | 270/6 |
| 6,018,687 | A | 1/2000 | Tabor | |
| 6,047,922 | A * | 4/2000 | Michalik | 242/615.21 |
| 6,588,739 | B1 * | 7/2003 | Weis | 270/6 |
| 6,695,250 | B2 * | 2/2004 | Michalik et al. | 242/615.21 |
| 6,820,839 | B2 * | 11/2004 | Weis | 242/615.21 |
| 2003/0075640 | A1 | 4/2003 | Weis | |

FOREIGN PATENT DOCUMENTS

| | | |
|---|---|---|
| DE | 36 02 894 C2 | 5/1989 |
| DE | 39 19 403 C1 | 9/1990 |
| GB | 5949035 | 6/1945 |
| GB | 1 546 798 | 5/1979 |
| WO | WO 01/70608 A1 | 9/2001 |

* cited by examiner

*Primary Examiner*—Ren Yan
(74) *Attorney, Agent, or Firm*—JonesTullarCopper, PC

(57) ABSTRACT

A web is guided in a processing machine by the use of a device which includes a regular device and at least one further web guiding element. These cooperate to subject the web to an offset or to a change in direction. The regular device and the at least one further web guiding element are arranged for mounting on a common guide in a direction that is transverse to the direction of travel of one incoming web.

7 Claims, 8 Drawing Sheets

DEVICES FOR GUIDING A PARTIAL WIDTH WEB, GUIDE ELEMENT FOR GUIDING A PARTIAL WIDTH WEB AND PROCESSING MACHINE COMPRISING SAID DEVICES

CROSS-REFERENCE TO RELATED APPLICATIONS

This application is the U.S. National Phase, under 35 USC 371, of PCT/DE2003/002526 filed Jul. 26, 2003, published as WO 2004/014770 on Feb. 19, 2004 and claiming priority to DE 102 35 391.3 filed Aug. 2, 2002, the disclosures of which are expressly incorporated herein by reference.

FIELD OF THE INVENTION

The present invention is directed to devices for guiding a web of partial width, a guide element for guiding a web of partial width, and a processing machine with these devices.

BACKGROUND OF THE INVENTION

In production or processing machines, for example printing presses, the webs of material to be produced or to be processed are often longitudinally cut on their way through the machine, and the partial webs being created are thereafter conducted to further processing stages. For this purpose the partial webs are conducted over guide rollers of various types, some of which extend over the entire width of the machine. In order to prevent sagging, such long guide rollers must then be designed to be appropriately heavy and have a correspondingly great inertia. In contrast thereto, a partial web touches or loops around only a portion of the length and has a distinctly reduced cross section in comparison with the entire web. These two effects cause increased fluctuations of the partial web, in particular during start-up operations or, for example, during regulation- or production-based speed changes, and therefore in losses in quality of the product, or even a web break.

WO 01/70608 A1 discloses a turning bar arrangement, wherein two turning bars of a substantially partial web width, are arranged, each on a support, transversely displaceable in respect to the direction of the incoming partial web. A registration roller is arranged respectively laterally outside the lateral frame, whose longitudinal axis extends substantially parallel with the lateral frame, and which is also transversely displaceable along a rail in respect to the direction of the incoming partial web.

A guide element, embodied as a registration roller, is disclosed in DE 36 02 894 C2, which is embodied so that its position can be changed and thereby changes the web path.

A frame in GB 1 546 798, having a plurality of turning bars and a plurality of registration rollers, can be moved as a whole laterally in respect to the incoming web. This entire frame can be replaced for taking various web divisions into account.

In GB 594 035 a deflection roller for already folded strands is disclosed downstream of the formers, which has several individually rotatable roller sections over the width of the strand.

SUMMARY OF THE INVENTION

The object of the present invention is directed to providing devices for guiding a web of partial width, a guide element for guiding a web of partial width, and a processing machine with these devices.

In accordance with the present invention, this object is attained by preferably including a registration device and a guide element arranged movably transversely in respect to a direction of an incoming web on a common guide element. Additionally, the devices preferably include at least one roller having a width transversely in respect to the running direction of the incoming web which is less than a maximum full web to be processed in the processing machine.

The advantages which can be obtained by the present invention lie, in particular, in that a web transport is also assured for partial webs by simple means at desired and preselectable speeds and web tensions. Inertia effects are reduced by the device, which would be caused in the course of conducting partial webs over non-driven guide elements extending over the entire possible web width, such as guide rollers. The above described effects on quality and safety are minimized.

The arrangement of two guide elements on a common support makes possible, for one, the mutual movement of the two guide elements, without it being basically necessary in case of a production change to perform their realignment with each other. The arrangement of two guide elements at least on a common guide device saves structural space and makes short running paths of the partial webs possible.

With some preferred embodiments it is furthermore possible to shorten the web path and to prevent a renewed tipping of the partial web in the course of a simple turning of the partial web.

A considerably more cost-effective and easier to manipulate solution has been created in comparison with individually movable guide elements.

The device has great advantages, particularly in connection with double-wide, and more particularly triple-wide printing presses, since continuous guide elements have a particularly large mass inertia because of their great width (and resultant large cross section). Also, in particular with the mentioned printing presses, it is possible to save structural space required for outward displaced registration rollers.

In a preferred embodiment, the registration roller in the superstructure, whose axis of rotation is oriented vertically in respect to a plane of the lateral frame, or parallel with the cylinders of a printing press, and/or the harp roller assigned to the same partial web, are embodied to be of partial width.

In a further preferred development, all non-driven guide elements assigned to the same and single partial web between longitudinal cutting devices and a first traction or former inlet roller assigned to the hopper are embodied to be of partial width or as divided rollers with several sections which can be independently rotated in the axial direction.

In connection with double-wide printing presses, only one such device, in the case of triple-wide printing presses two of these devices are necessary per uncut full web.

In comparison with a double-wide printing press and with the same target thickness of a product to be achieved, with a triple-wide embodiment of the printing units the production dependability of the printing press is further increased because of fewer units needed, and investment is further reduced. But while maintaining the number of printing units, the output of the printing press, or of each printing unit, can be increased by 50%.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
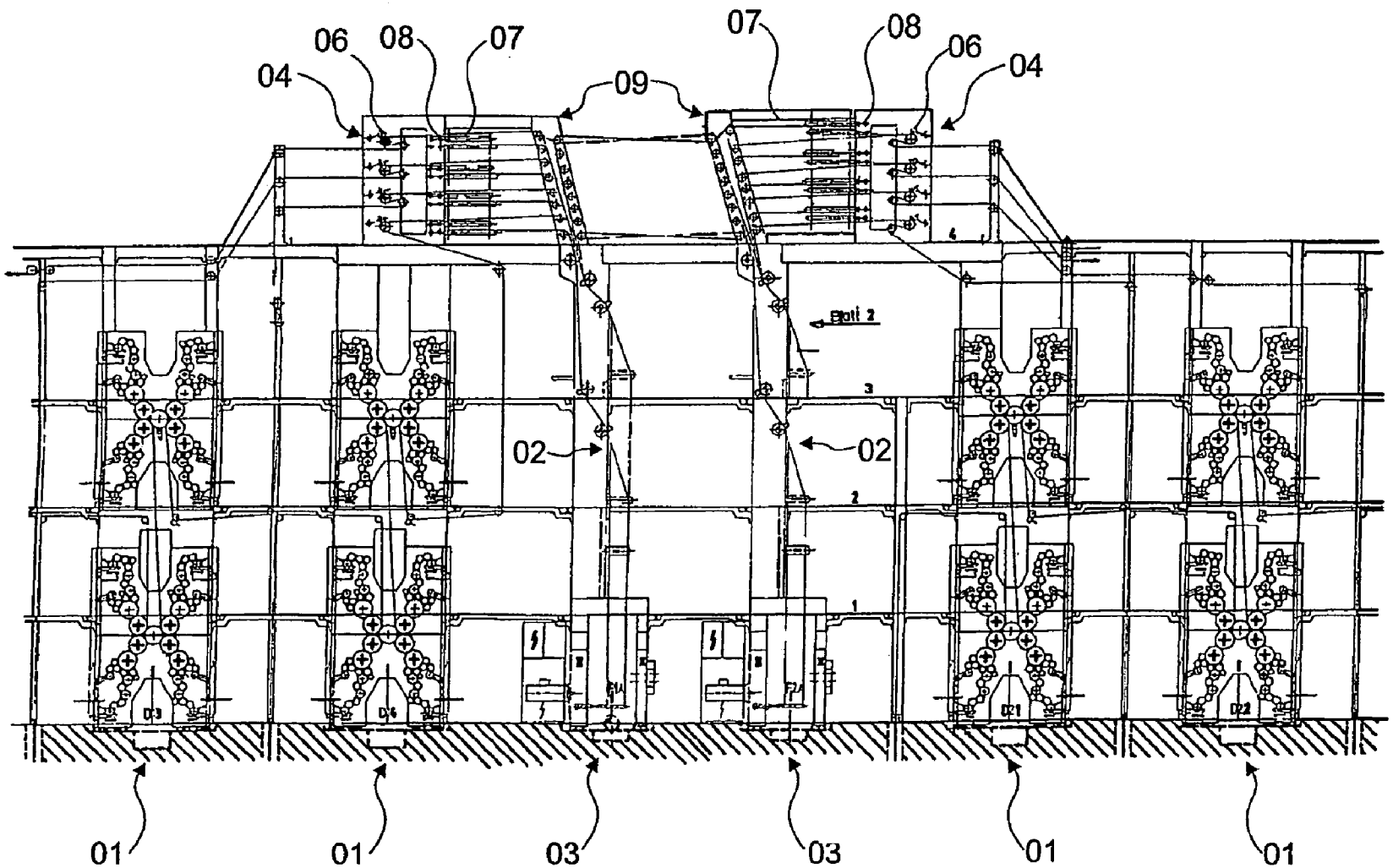
FIG. 1, a web-fed rotary printing press in accordance with the present invention in a lateral view, FIG. 2, a folding structure of a web-fed rotary printing press in accordance with the present invention, FIG. 3, a first preferred embodiment of a superstructure in a perspective plan view in accordance with the present invention, FIG. 4, a view from above in accordance with FIG. 3, FIG. 5, a variant of the first preferred embodiment in accordance with the present invention, FIG. 6, a second preferred embodiment of a superstructure in a perspective plan view in accordance with the present invention, FIG. 7, a lateral view in accordance with FIG. 3, and FIG. 8, a third preferred embodiment of a superstructure in a perspective plan view in accordance with the present invention.

The web-fed rotary printing press represented by way of example in FIG. 1 has a left and a right section, each with at least two printing towers 01. The printing towers 01 have printing units which are, for example, triple-wide, i.e. are designed for imprinting respectively six axially side-by-side arranged newspaper pages. The printing units are embodied as satellite printing units with at least two transfer cylinders assigned to a common satellite cylinder and respectively one forme cylinder working together with the transfer cylinder. The preferred embodiment of the printing units as nine cylinder satellite printing units assures a very good registration maintenance, or little fan-out. However, the printing units can also be embodied in other ways.

Each of the transfer cylinders has a circumference corresponding to at least two vertical newspaper pages arranged one behind the other in the circumferential direction. In a preferred manner the forme cylinder can also have a circumference corresponding to at least two vertical newspaper pages arranged one behind the other in the circumferential direction.

Two folding structures 02 are arranged between the sections, each of which has formers arranged, for example, on two different levels one above the other. However, the printing press can also have only one common folding structure 02 arranged between the sections, or only one section and an associated folding structure 02. Also, the respective folding structure 02 can be designed with only one level of formers. One or several folding apparatus 03 are assigned to each folding structure 02. The web is provided to the printing units from rolls in particular with the use of roll changers that are not herein specifically represented.

One superstructure 04 per section is provided above the printing towers 01, in which webs are cut by means of longitudinal cutting devices 06. Partial webs, are offset and/or tipped, if required, by means of turning arrangements 07 and aligned with each other in the linear register by means of registration arrangements, which are not specifically represented in FIG. 1, and are further conducted on top of each other. Guide elements 08 are indicated in FIG. 1, on which non-represented supports, described below, for the lateral movement of turning bars 07 and, if required, a registration device, can be arranged. Viewed in the running direction of the web, in front of one of the formers arranged one on top of the other, the superstructure 04 has a roller group 09, a so-called harp 09 with several guide elements embodied as harp rollers, which determine the entry of webs into the formers. For saving structural space, in the example only, one harp 09 is arranged for two formers arranged one on top of the other, from which webs can be conducted to the one and/or the other of the formers arranged on top of each other. In this preferred embodiment, it is only arranged in front of the upper former.

Figure 2:
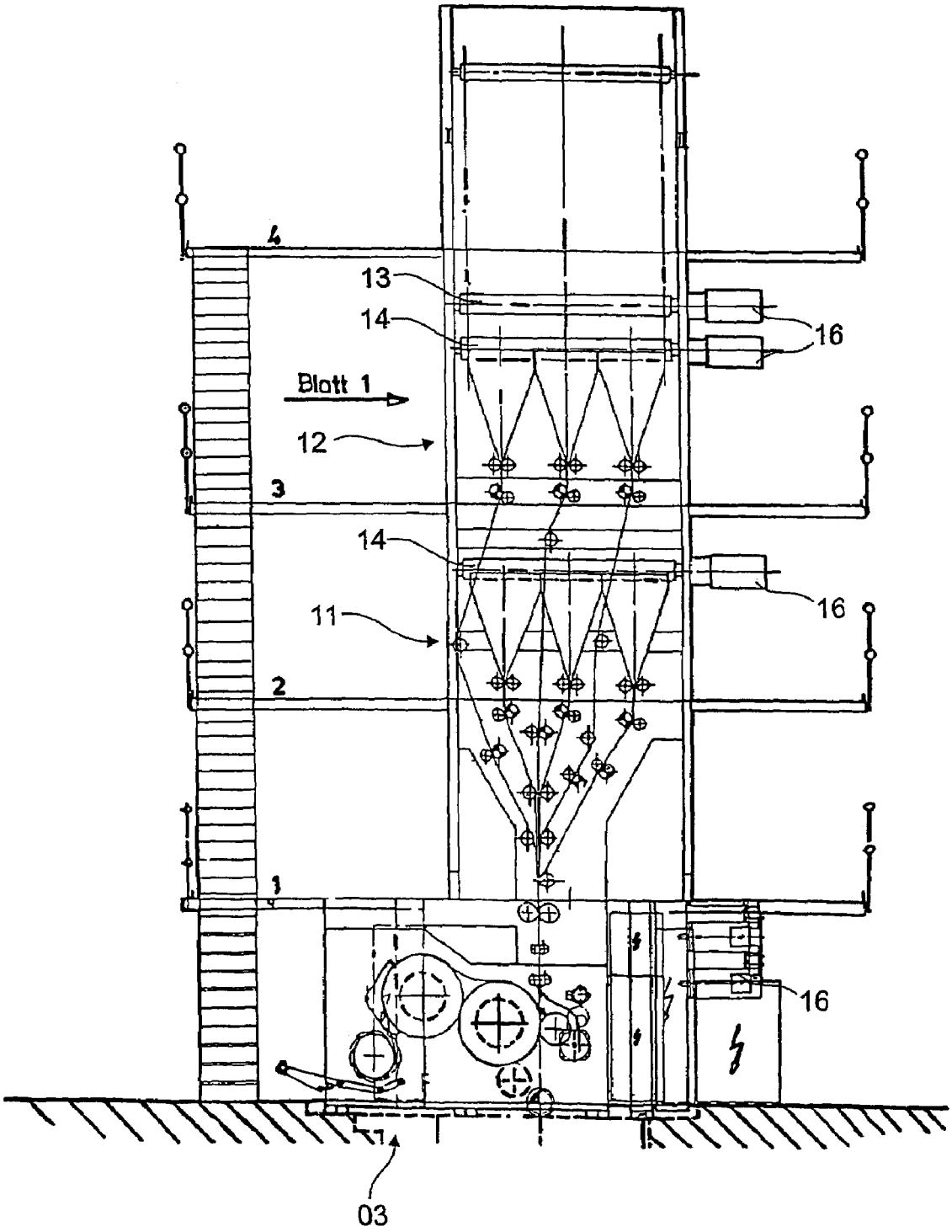

In what follows, the group of rollers is understood to be harp rollers which represent the two last non-driven guide rollers upstream of the former inlet viewed in the running direction of the webs. As a rule, they are the last non-driven rollers assigned to only a single layer of material to be imprinted. As shown in FIG. 2, downstream of this it is possible for several webs, or partial webs, for example, to be brought together into a strand and to be conducted, for example, over the traction roller 13 and/or former inlet roller 14.

The folding structure 02 for the triple-wide printing press, represented in FIG. 2, has, for example, three side-by-side arranged lower formers 11, and three upper formers 12, arranged above them and side-by-side in respect to each other. In a preferred embodiment, traction rollers 13 and former inlet rollers 14 respectively placed upstream of the formers 11, 12 each have their own drive motors 16, the same as the folding apparatus 03, as well as traction rollers provided in the folding structure 02. FIG. 2 shows only partial fill-in of the respective traction rollers.

The above mentioned folding structure 02 with only one harp 09 for two formers arranged on top of each other, as well as the elements of the superstructure 04 described in greater detail in what follows, are also suitable for other printing presses with different cylinder widths and cylinder circumferences. The folding structure 02 and the superstructure 04 have been represented by an example of a triple-wide printing press.

Figure 3:
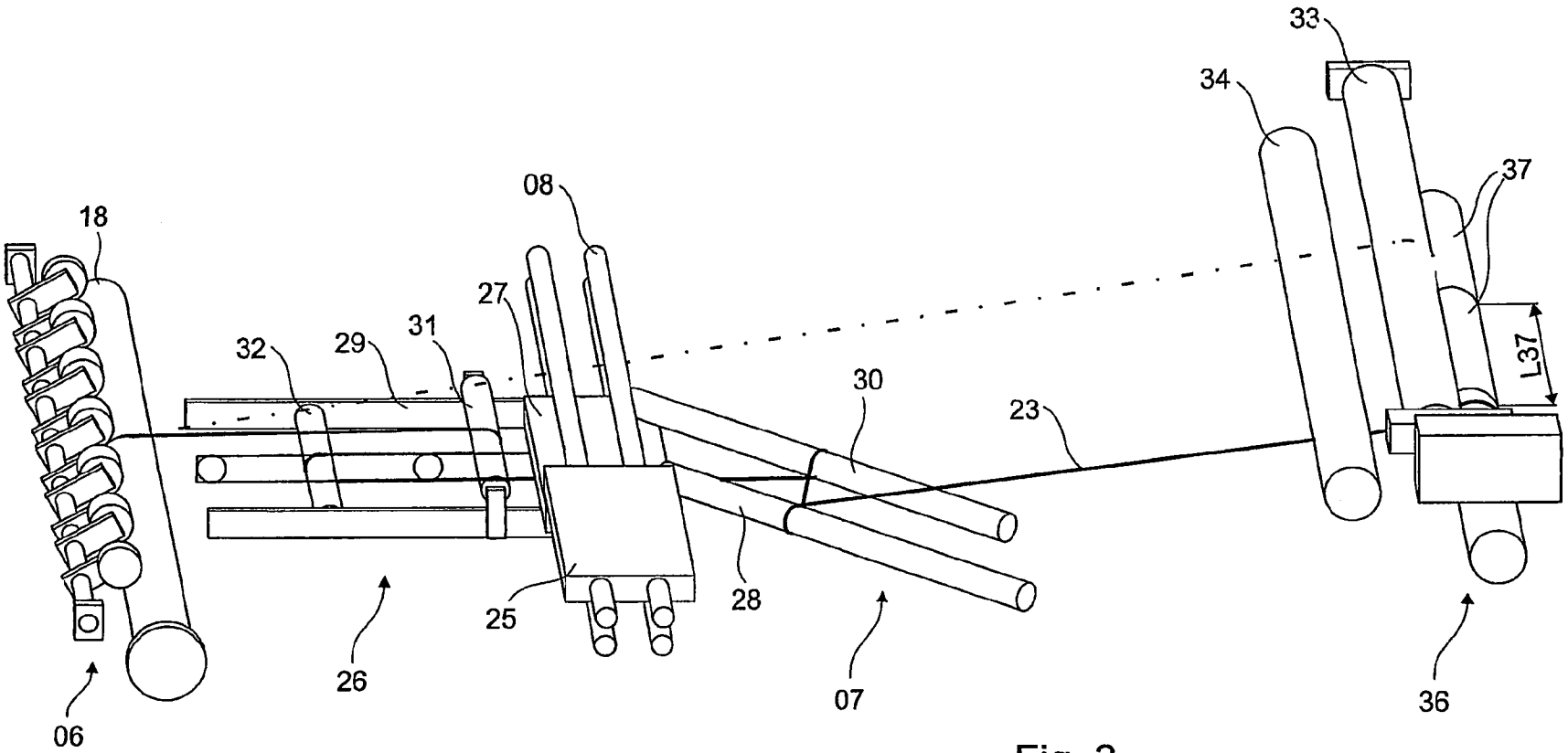
Figure 4:
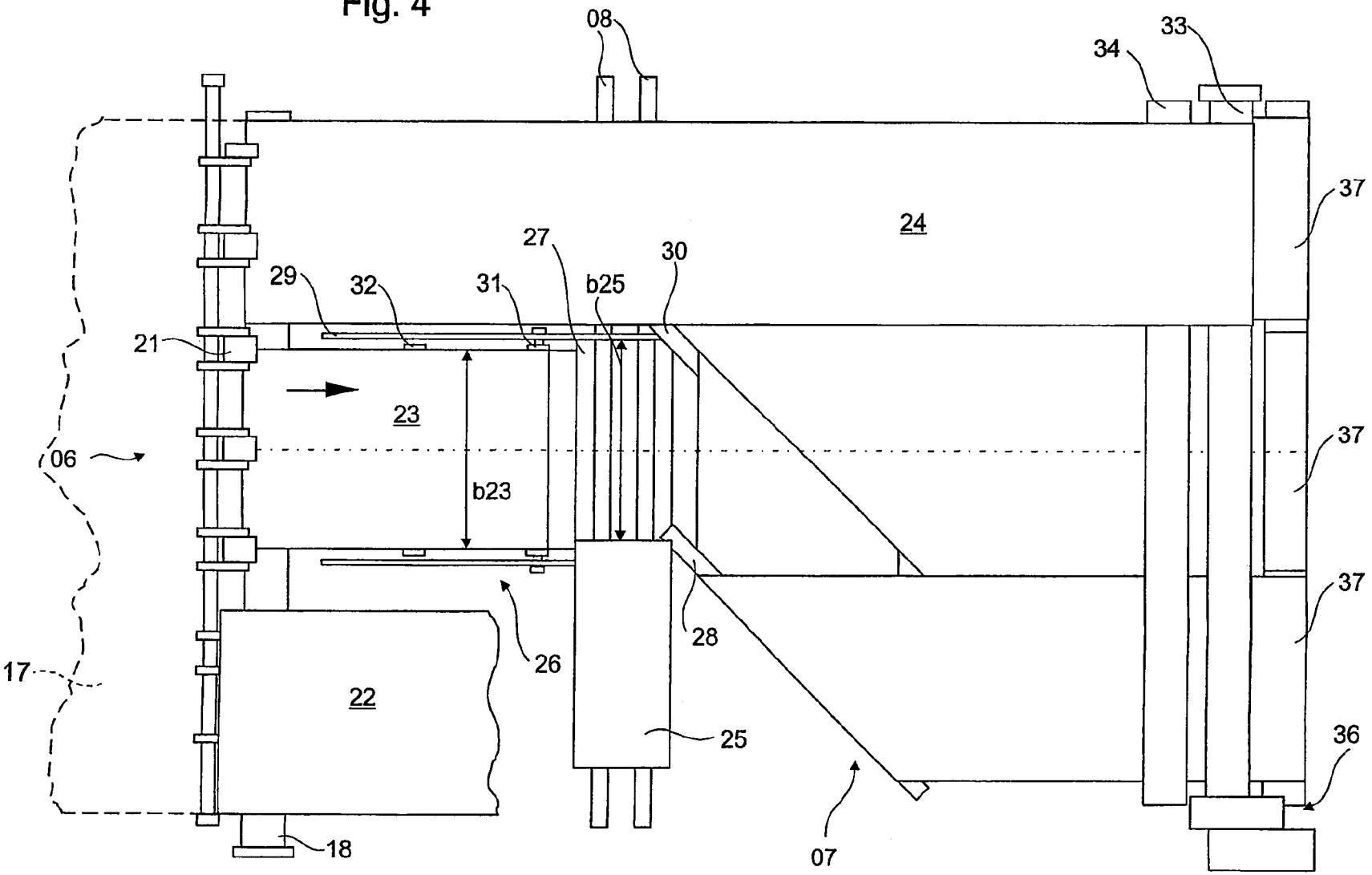

In a perspective oblique view, FIG. 3 shows a first preferred embodiment of at least a portion of the superstructure 04. A full web 17, for example, a web 17 of a width which, in case of a double-wide printing press, substantially corresponds to four, and in case of a triple-wide printing press to six, side-by-side arranged vertical newspaper pages, is conducted to a longitudinal cutting device 06. The latter has, for example, a traction roller 18, with which contact rollers can cooperate in order to prevent slippage. As shown in FIG. 4, cutters 21 can be placed against the surface area of the traction roller 18 in order to cut the web 17, depending on the requirements, into webs 22, 23, 24 of partial width, in particular into partial webs 22, 23, 24.

Webs 22, 23, 24 of partial width can also be conducted to the superstructure 04 without longitudinal cuts, in that already a web 22, 23, 24 of partial width is conducted to the printing press, or a printing tower, or a printing unit. It than has a width, for example, which is clearly less than a width which can be maximally imprinted by the printing unit. For example, the width is at least ¼ less in connection with a double-wide press, or at least ⅙ lesswith a triple-wide press, than a width which can be maximally imprinted by the printing unit.] The following remarks provided below regarding guide elements of partial web width are also to be understood in this sense.

For the purpose of improved representation, the partial webs 22, 23, 24 are shown in FIG. 4 narrower and spaced apart from each other. By way of example, in FIG. 4 the partial web 24 is represented as a partial web 24 running straight ahead, the partial web 23 as a partial web 23 turned from the center toward the outside, and the partial web 22 only incompletely. For example, the partial web 22 could be conducted straight ahead, like the partial web 24, or turned into another direction by means of a second such turning arrangement 07, the same as the partial web 23. A second turning arrangement can be located above or below the plane defined by the partial web 23 entering into the first turning arrangement 07.

In contrast to the other partial webs 22, 24, a partial web 23, which was cut like the partial web 23 and subsequently offset, turned and/or tipped, is given an offset in the running direction of the partial web 23 and therefore its linear registration must be corrected by means of a registration device 26. Since this offset specifically affects this cut partial web 23 and is tied to its web guidance, the registration device 26 is now assigned to at least one of the web guidance elements which determine the running of the partial webs 22, 23, 24, such as the turning arrangement 07 or the harp 09, for example.

In FIGS. 3 and 4 the registration device 26 is structurally assigned to at least one guide element 28, 30, embodied as a turning bar 28, 30, of the turning arrangement 07, which impresses a directional change on the partial web 23. The registration device 26, and at least one of the turning bars 28, 30 are arranged on a common support 25, 27, which is arranged, movable transversely in respect to the running direction, on one or several guide elements 08 in a plane parallel with the plane of the incoming partial web 23. The elements of the registration device 26 and of the turning arrangement 07 acting together with the partial web 23 are dimensioned in their width transversely to the running direction in such a way that their projection substantially corresponds to the width b23 of the incoming partial web 23.

In FIGS. 3 and 4 the turning arrangement 07 has a pair of parallel turning bars 28, 30, each of which is arranged on its own support 25, 27 at an angle of approximately 45° in respect to the running direction of the incoming partial web 23, for example. In the area of their surface, the turning bars 28, 30 can be provided with openings for an exiting air flow and/or with a surface which reduces friction. They can be pivotable, or can be mounted, on the support 25, 27 around an axis vertically in respect to the plane, or around an axis parallel with the running direction of the incoming web 23.

Upstream of the turning arrangement 07, or of the first rotating turning bar 30, the registration device 26 is arranged on the support 27, and on a frame 29 has a roller 31, which is stationary in respect to the frame 29, for example a deflecting roller 31, and a roller 32 which is movable in respect to the frame 29 parallel with the running direction, for example a registration roller 32. If the support 27 is moved along the guide elements 08, it is simultaneously possible to bring the turning arrangement 07, as well as the registration device 26, into a different alignment, i.e. into the running path of another partial web 22, 24. Since the turning bar 30, as well as the registration device 26, are fixedly connected with the support 27, neither their basic alignment in respect to each other needs to be reset, nor are two work steps and/or two drive mechanisms required.

If each of them is arranged on supports 25, 27, the two turning bars 28, 30 are individually movable on the respective guide elements 08. In this way an offset over one or two partial web widths can take place, depending on the relative position of the turning bars 28, 30. However, it is also possible to arrange both turning bars 28, 30 on a common support 25, 27.

If only one turning bar 30 is arranged together with the registration device 26 on the support 27, this must be the turning bar 30, which revolves first following the registration device 26. In that case the second turning bar 28 can be possibly arranged on its own support 25. This further support 25 can then possibly be arranged on the same guide elements 08, and can possibly be driven together with the support 27, or separately.

The outgoing partial webs 22, 23, 24 can either be conducted via a wide registration roller 33 and a wide deflecting roller 34 intended for a wide web 27 to a wide harp roller, not specifically represented in FIGS. 3 or 4, or, as shown, directly to a harp roller 36, divided in its longitudinal direction by sections 37. The number and length L37 of the sections 37 substantially corresponds to the number and width b23 of the possible partial webs 22, 23, 24.

In an advantageous further development, two such supports 27 equipped with registration and turning devices 26, 27 are provided per whole web 27 in the superstructure 04 of a triple-wide printing press. This is similar to the preferred embodiment in accordance with FIGS. 6 and 7, but applied to FIGS. 3 and 4.

As represented in FIG. 4, the support 25 can be substantially designed with a width b25, which approximately corresponds to the width b23 of a partial web 23. In the case of a support 25, 27 embodied commonly for both turning bars 28, 30, it can also have the approximate width b23 of two partial webs 22, 23, 24, and can be designed to be stepped, if required, and arranged per turning bar 28, 30 on guide elements 08 on vertically offset planes. In this way the two turning bars 28, 30 are automatically arranged on different planes, as desired. The embodiment with the width b23 of two partial webs 22, 23, 24 can be advantageous for standardizing the support 27 if it is also to be embodied with turning bars 28 extending orthogonally in respect to each other, as will be represented in FIG. 5 in what follows.

The reference symbols of recurring parts have been retained in the following variations of the present invention. A detailed description, as well as their function, is not described again and should be appropriately transferred. Also, as shown in FIG. 3 in view of greater clarity, the partial webs 22, 23, 24 are no longer represented, but are shown as solid lines symbolizing a respective partial web, if required.

Figure 5:
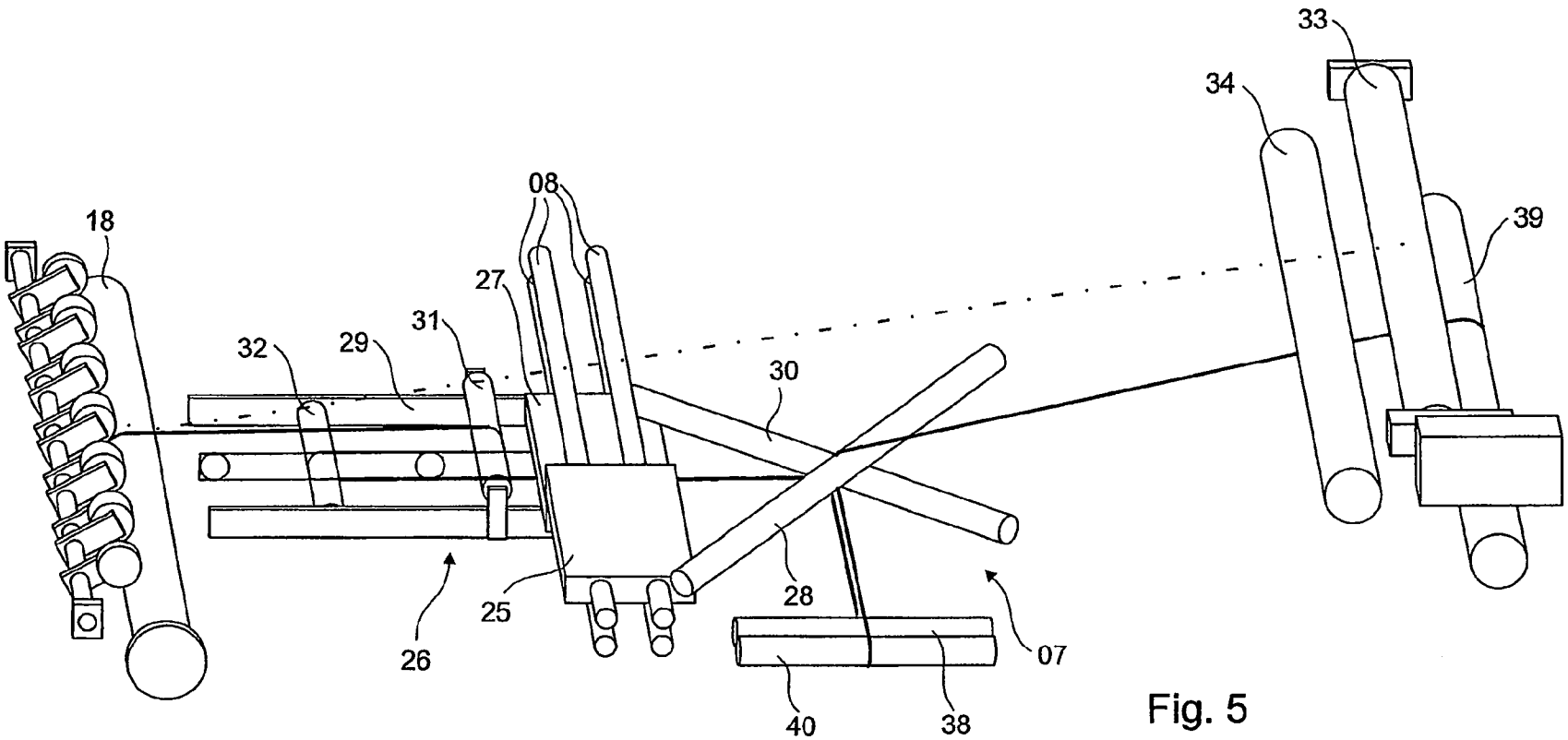

The turning bars 28, 30 in a variation of the first preferred embodiment in accordance with FIG. 5 are located orthogonally to each other and make the tipping of the partial web 23 possible. After passing through the registration device 26, the partial web 23 is first conducted around one of the turning bars 28, 30, and subsequently conducted around a first roller 38, wherein a first contact line on the surface area of the latter with the incoming partial web 23 lies substantially on a common plane with a contact line on the surface area of the first circled turning bar 28, 30 with the exiting partial web 23. The second roller 40 around which movement subsequently occurs is arranged in such a way that a last contact line on its surface area with the exiting partial web 23 substantially lies on a common plane with a first contact line on the surface area of the second turning bar 28. The axes of rotation of the rollers 38, 40 extend vertically in respect to the axis of rotation of the traction roller 18. Finally, the partial web 23 is conducted around the second turning bar 28. Depending on the position of the turning bars 28, 30 in relation to each other in a direction transversely in respect to the incoming partial web 23, the partial web 23 is additionally turned into another alignment. No turning takes place if the two turning bars 28 cross in the area of the center line of the incoming partial web 23. By way of example, in FIG. 5 the partial web 23 is conducted to a broad, continuous harp roller 39. The variations described in connection with FIGS. 4 and 5 are interchangeable.

Figure 6:
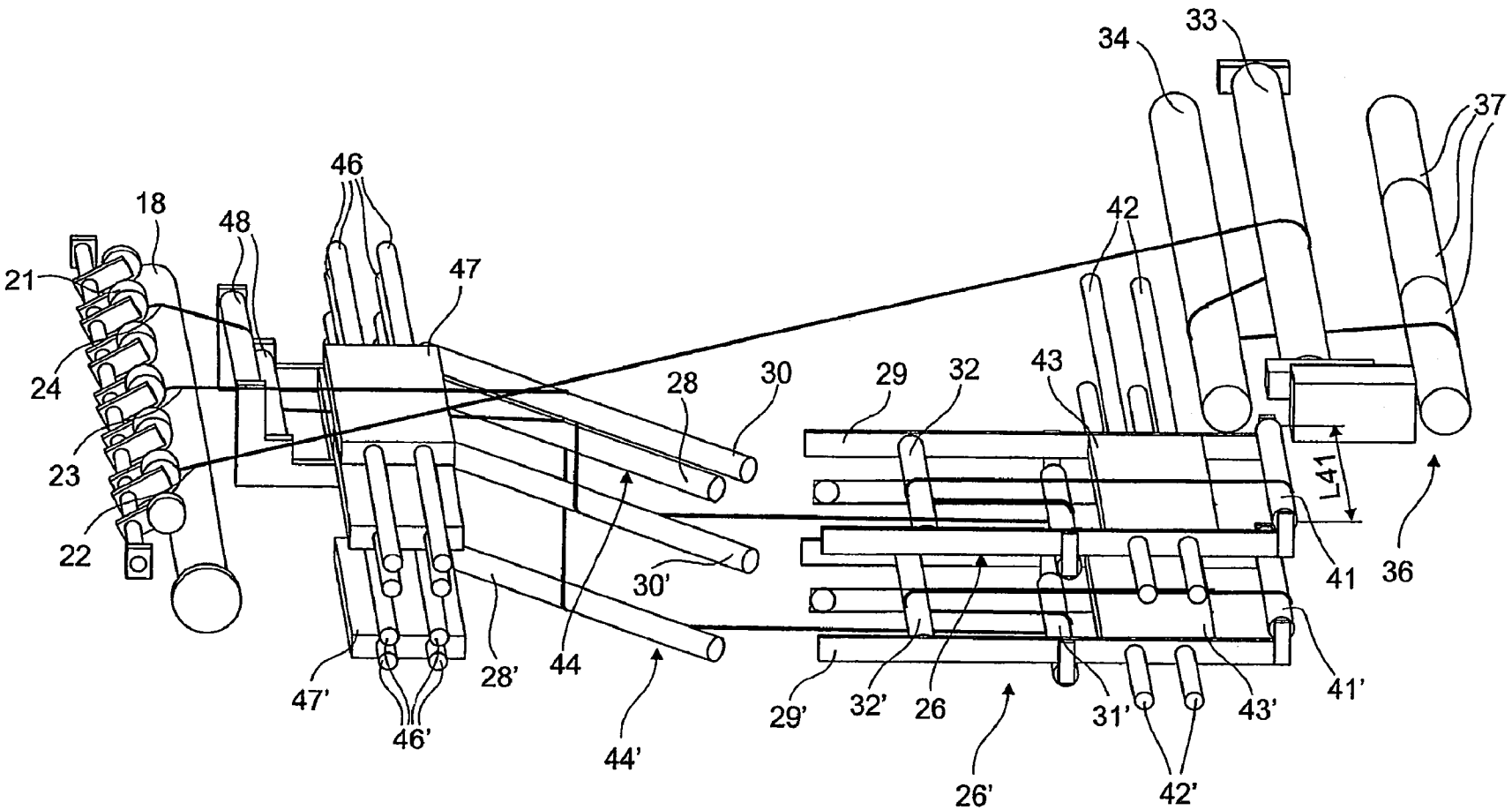
Figure 7:
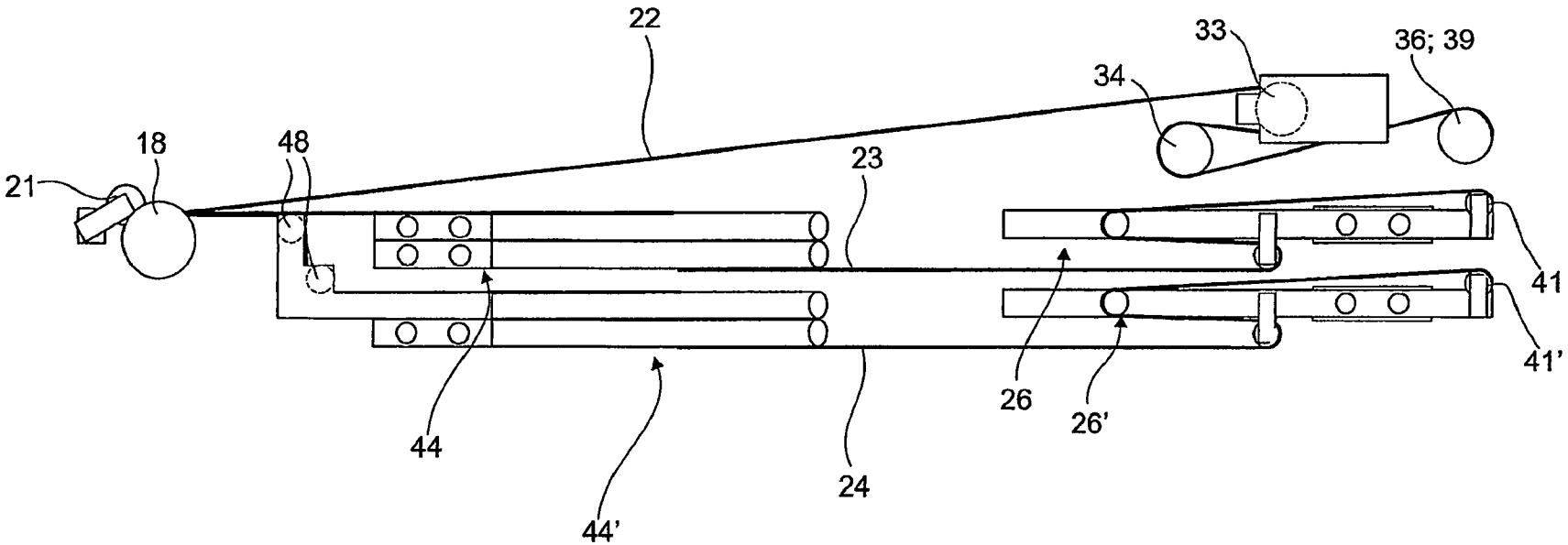

In a second preferred embodiment as shown in FIGS. 6 and 7, the registration device 26 of a width of a partial web is structurally assigned not to the turning arrangement 07, but to a guide element 41, for example a roller 41, in particular a harp roller 41, for example, of the width of a partial web and extending with its axis of rotation vertically in respect to the running direction of the incoming partial web 23.

As represented in FIG. 6, the registration device 26 is arranged with its roller 31 fixed to the frame, as well as the movable frame 32, on a support 43, which can be moved along at least one guide element 42 transversely in relation to the incoming partial web 23. In addition, the harp roller 41 is arranged downstream either on a frame which is separately connected with the support 43, or on the extended frame 29, and has a length L41 which substantially corresponds to the width b23 of the partial web 23. If now the support 43 is moved along the guide elements 42 transversely in respect to the running direction, it is possible to simultaneously bring the registration device 26, as well as the harp roller 41 of a width of a partial web, into a different alignment, i.e. into the running path of a different partial web 22, 24.

Since the harp roller 41, as well as the registration device 26 are fixedly connected with the support 43, it is neither necessary to reset their basic orientation toward each other, nor are two operating steps and/or two drive mechanisms required. In contrast to a harp roller 39, as shown in FIG. 5, extending over the entire width b17 of a full web 17, the harp roller 41 of the width of half a web has a considerably lower inertia, because it is shorter and therefore only needs a reduced cross section.

A turning arrangement 44 is assigned to the support 43 having the registration device 26 and the harp roller 41. In a preferred embodiment, this turning arrangement 44 is arranged, similar to the preferred embodiments in accordance with FIGS. 3 to 5, transversely to the running direction of the incoming partial web 23 on a support 47, which is movable along a guide element 46. Depending on the requirements, the turning bars 28, 30 can again be aligned parallel in pairs, or orthogonally.

In a further development represented in FIG. 6, the superstructure 04 for a triple-wide web 17 has two such devices, which are offset vertically in respect to each other. Thus, one of the three partial webs 22, 23, 24 can be conducted straight ahead, while the option of turning and subsequent registration exists for the other two partial webs 23, 24, 22. The respectively second, vertically offset devices have the same reference symbols in FIG. 6, but are identified by an apostrophe.

For conducting one of the partial webs 22, 23, 24 into a vertically offset plane, one of the two supports 47, 47' has, upstream of the assigned turning arrangement 44, 44', at least one, advantageously two rollers 48 substantially of the width of a partial web, for example deflecting rollers 48.

For example, in FIG. 6 all three partial webs 22, 23, 24 are conducted one on top of the other, wherein the partial web 22 is conducted straight ahead, the center partial web 23 is laterally offset by the width of a partial web laterally underneath the first partial web 22 by means of a turning arrangement 44, and the third partial web 24 is initially offset vertically by means of the rollers 48 and subsequently laterally by two partial web widths underneath the first two partial webs 22, 23.

FIG. 7 shows a possible running course of three partial webs 22, 23, 24, wherein the partial web 23 is turned by means of the turning arrangement 44, and conducted to the registration device 26 onto the harp roller 41. Initially, the partial web 24 is vertically offset by the rollers 48 before it is turned by means of the turning arrangement 44', and conducted to the registration device 26' onto the harp roller 41'. The partial web 22 runs straight ahead, for example, over the wide registration roller 33 and the wide deflection roller 34 onto the wide harp roller 36 or a section 37 of the divided one. In place of this running course of the straight ahead running partial web 22, it is also possible to provide a further harp roller of partial web width, not specifically represented, onto which the partial web 22 is directly conducted without working together with the registration and the deflection rollers 33, 34.

The arrangement of the deflection rollers 48, as well as the vertically offset arrangement of second devices for turning and registration of a second partial web 22, 23, 24 in the preferred embodiment in accordance with FIGS. 6 and 7 is to be transferred in principle to the preferred embodiment in accordance with FIGS. 3 to 5. Accordingly, in this case and in particular in connection with triple-wide webs 17 or printing units, a second support 27', not specifically represented, with a turning arrangement 07', as well as a registration device 26', is arranged, movable transversely in respect to the running direction of the incoming partial web 22, 23, 24, on at least one further guide element 08'.

The "single" embodiment from FIGS. 3 to 5, in particular in connection with webs 17 or printing units of only double width, should correspondingly be transferred to the preferred exemplary embodiment in accordance with FIGS. 6 and 7. Only the elements or devices with apostrophes or without apostrophes need to be removed in this case.

Figure 8:
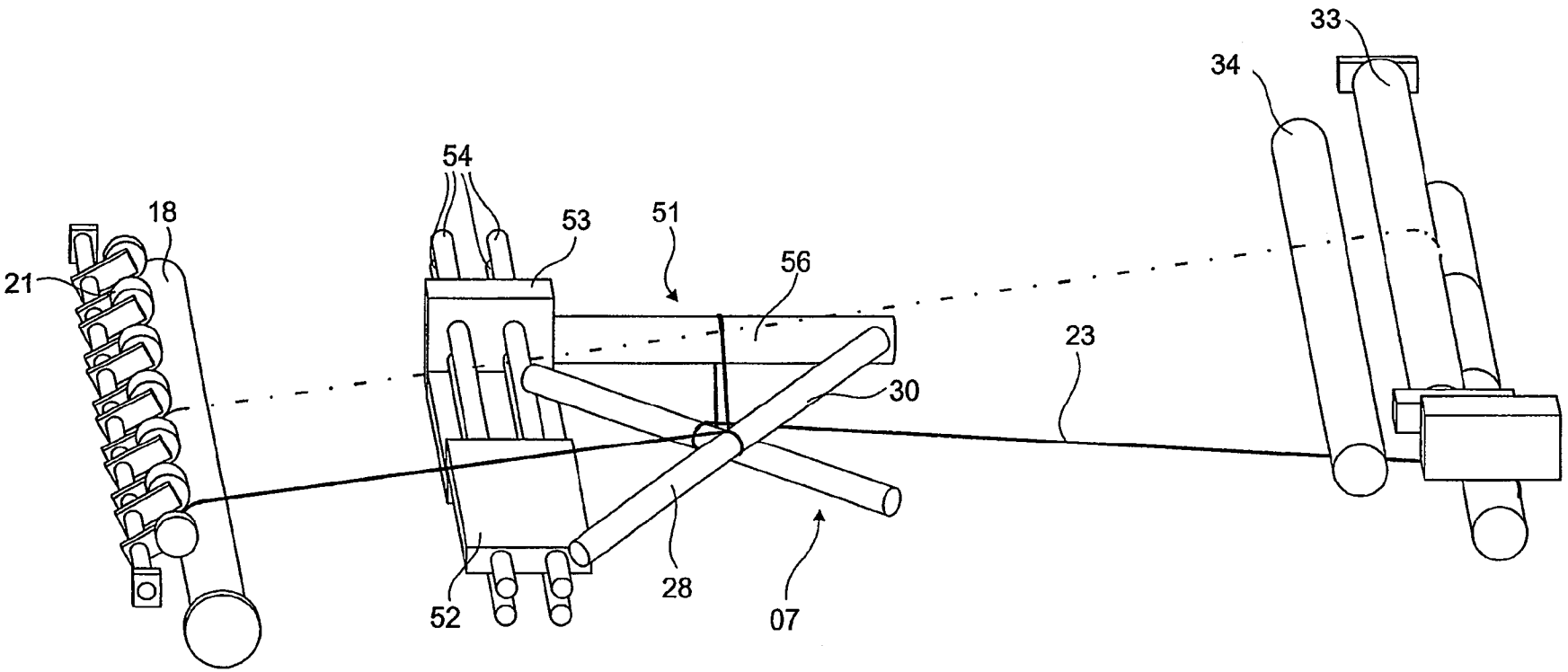

In a third preferred embodiment shown in FIG. 8, in contrast to the first preferred embodiment, a registration device 51 is not connected directly and rigidly with a support 52 for the turning arrangement 07, for example with a turning bar 28, 30, but instead is arranged on its own support 53. Both supports 52, 53 are arranged, movable transversely to the running direction, on at least one common guide element 54 in a plane parallel with the plane of the incoming partial web 23. As in the preceding preferred embodiments, the width of the parts of the registration device 51 and of the turning arrangement 07 acting together with the corresponding partial web 23 is of such a dimension that their projection substantially corresponds to the width b23 of the incoming partial web 23. Regarding the possible running paths of partial webs 22, 23, 24, which may run straight ahead, as well as be tipped and, if required, be turned, reference is substantially made to the explanations regarding FIG. 5. However, in contrast to FIG. 5, the tipped partial web 23 is not conducted to the registration device 51 prior to passing through the two turning bars 28, 30, but after looping around the first and prior to looping around the second turning bar 28.

In a preferred embodiment, the registration device 51 has only a single registration roller 56, whose axis of rotation extends substantially vertically in respect to the axis of rotation of the traction roller 18. The registration roller 56 is arranged in such a way and its cross section is of such dimensions that the sections of the partial web 23 extending between the registration roller 56 and respectively one turning bar 28 form a plane.

The registration device 51 embodied in this way requires no individual guide element and, as a rule, does not, or only slightly, project laterally out of the exterior profile of the printing press. Furthermore, the distances traveled by the turned partial web 23 are considerably reduced in comparison to registration rollers arranged outside of the lateral profile of the printing press, i.e. for example outside of a lateral frame.

The partial web 23 tipped in this way and, if required, turned, as well as partial webs 22, 23, 24 running straight ahead, or also a second tipped and possibly turned partial web 22, 23, 24, can be further conducted, as in the preferred embodiments in accordance with FIGS. 3 to 5, if required, around wide registration and deflection rollers 33, 34, around wide or divided harp rollers 39, 36, or also around partially wide harp rollers 41 represented in accordance with FIG. 6. Designed the same as within the scope of the second preferred embodiment, a device in accordance with FIG. 8, with the two supports 52, 53, the registration roller 51 and the turning arrangement 07, as well as the guide elements 54, in particular for triple-wide printing presses, can be embodied to be twice vertically offset per full web 17. Regarding the device required for offsetting the respective partial web 22, 23, 24, reference is made to the above mentioned preferred embodiment and the rollers 48 to be arranged on the support 52, but not specifically represented here.

The guide elements 08, 42, 46, 54 of the preferred embodiments mentioned here can be realized in diverse ways. For example, and as represented, each support 25, 27, 43, 47, 52, 53 can be guided by several guide elements 08, 42, 46, 54 of the same or different types. For example, the guide elements 08, 42, 46, 54 can be designed as spindles 08, 42, 46, 54 with screw threads at least in portions, which are rotatably seated on both sides, and the spindles 08, 42, 46, 54 mutually assigned to a support 25, 27, 43, 47, 52, 53 can be rotatorily driven by means of a common drive mechanism, not specifically represented.

However, the supports 25, 27, 43, 47, 52, 53 can also be guided in the manner of sliding blocks 25, 27, 43, 47, 52, 53 in rigid guide elements 08, 42, 46, 54, for example profiled elements 08, 42, 46, 54. In this case driving of the support 25, 27, 43, 47, 52, 53 can also take place by means of a driveable spindle, or in other ways.

Although the seating of the turning bars 08, as well as of the registration roller 56 in FIG. 8, has been represented as an overmounted seating, it can also be provided on both sides. For this purpose either further guide elements for receiving further supports can be arranged, or the existing multiple guides 08, 46, 54 are appropriately divided. However, overmounted seating offers advantages in regard to technical outlay and a reduced danger of tilting.

In a preferred embodiment of a processing machine for web-shaped material, for example a web-fed rotary printing press, in particular in connection with a superstructure 04, all rotating guide elements 41, 31, 32, 48, which are only driven by friction and work together with a web 22, 23, 24 of partial width, are embodied to be of partial width, or as a guide element 36 which can be rotated in sections. This means that, depending on the layout of the press, the last non-driven roller 36, 41, which is assigned to a layer and located upstream of the formers 11, 12, a registration roller 32, if provided, and possibly one or several deflection rollers 31, 48, are designed to be of partial width, or to be rotatable in sections.

Still further guide elements, in particular of the partially wide or sectionally rotatable type, can be assigned to a partial web 22, 23, 24 in the superstructure 04. Preferably, all rollers assigned to a partial web 22, 23, 24, or to their running paths between the longitudinal cutting device 06 and the formers 11, 12, in particular the non-driven rollers 31, 32, 36, 41, 48, are designed to be of partial width or to be sectionally rotatable, and turning bars 28, 31 possibly provided in a further development, are designed to be of partial width.

While preferred embodiments of devices for guiding a partial width web and processing machines including the devices, in accordance with the present invention, have been set forth fully and completely hereinabove, it will be apparent to one of skill in the art that various changes could be made without departing from the true spirit and scope of the present invention which is accordingly to be limited only by the appended claims.

The invention claimed is:

1. A device for guiding webs of partial width in a processing machine comprising:

a first common support connecting a first registration device and a first guide element, said first common support being movable on a further guide element transversely in a direction of a first incoming web of partial width;

a second common support connecting a second registration device and a second guide element, said second common support being movable on a further guide element transversely in a direction of a second incoming web of partial width;

said first guide element and said second guide element imparting a directional change or an offset in respect to a running direction of the first incoming web of partial width and the second incoming web of partial width; and said first registration device and said second registration device being positioned so that the first incoming web of partial width is in a longitudinal registration in relation to the second incoming web of partial width.

2. The device of claim 1, wherein the first incoming web of partial width or the second incoming web of partial width is a longitudinally cut partial web of a full web passing through the processing machine.

3. The device of claim 1, wherein the first registration device and the first guide element are both assigned to the first incoming web of partial width.

4. The device of claim 1, wherein the first guide element is a turning bar.

5. The device of claim 1, wherein the first guide element is a last non-driven roller, arranged upstream of a former and only assigned to the first incoming web of partial width.

6. The device of claim 1, wherein said first registration device and said first guide element are each dimensioned in width transversely to the running direction of the first incoming web of partial width in such a way that each has a projection less than a maximum web to be processed in the processing machine.

7. The device of claim 1, wherein said first registration device and said first guide element are each dimensioned in width transversely to the running direction of the first incoming web of partial width in such a way that each has a projection that substantially corresponds to a width of the first incoming web of partial width.

* * * * *